US007076424B2

(12) United States Patent
Nomura

(10) Patent No.: US 7,076,424 B2
(45) **Date of Patent: *Jul. 11, 2006**

(54) SPEECH CODER/DECODER

(75) Inventor: Toshiyuki Nomura, Tokyo (JP)

(73) Assignee: NEC Corporation (JP)

( * ) Notice: Subject to any disclaimer, the term of this patent is extended or adjusted under 35 U.S.C. 154(b) by 294 days.

This patent is subject to a terminal disclaimer.

(21) Appl. No.: 10/632,974

(22) Filed: Aug. 4, 2003

(65) Prior Publication Data

US 2004/0024595 A1 Feb. 5, 2004

Related U.S. Application Data

(62) Division of application No. 09/795,386, filed on Feb. 28, 2001.

(51) Int. Cl.
*G10L 19/02* (2006.01)

(52) U.S. Cl. ..... 704/229; 704/221; 704/219; 704/223

(58) Field of Classification Search ..... 704/223, 704/219, 229

See application file for complete search history.

(56) References Cited

U.S. PATENT DOCUMENTS 5,727,122 A * 3/1998 Hosoda et al. ..... 704/223
2004/0024595 A1* 2/2004 Nomura ..... 704/219

* cited by examiner

*Primary Examiner*—Susan McFadden
*Assistant Examiner*—Huyen X. Vo
(74) *Attorney, Agent, or Firm*—Dickstein, Shapiro, Morin & Oshinsky, LLP.

(57) ABSTRACT

A coding parameter control circuit 31 computes frame length from bit rate and coding delay, and provides the computed frame length data to a CELP coding circuit 32. On the basis of the computed frame length, the coding parameter control circuit 32 selects control parameters from a table, in which a plurality of control parameters for controlling the operation of the CELP coding circuit are set, on the basis of the bit rate, and provides the selected control parameters to the CELP coding circuit. The coding parameter control circuit provides the sub-frame length, and bit number distributed to the multi-pulse signal to the multi-pulse signal generation parameter setting circuit 33. The multi-pulse signal coding parameter setting circuit 33 computes pulse number of multi-pulse excitation signal, pulse position candidates of each pulse and candidate positions thereof from the sub-frame length and bit number of multi-pulse signal.

13 Claims, 11 Drawing Sheets

SPEECH CODER/DECODER

CROSS-REFERENCE TO RELATED APPLICATIONS

This is a divisional of U.S. patent application Ser. No. 09/795,386, filed Feb. 28, 2001 in the name of Toshiyuki NOMURA.

BACKGROUND OF THE INVENTION

The present invention relates to a speech coder/decoder for high quality coding speech signal with designated parameters.

As a usual controllable bit rate speech coder/decoder, a CDMA (Code Division Multiple Access) system is well known in the art. This system is disclosed in, for instance, "Enhanced Variable Rate Coded Speech Service Option 3 for Wide and Spread Spectrum Digital Systems", Standardization Recommendation Specifications, IS-127, TIA TR45 (Literature 1).

In this system, CELP (code excited linear prediction) coding system control parameters are set from a table, which is produced in advance from results of bit rate determination on the basis of input signal features, and the input signal is coded on the basis of the control parameters set in this way. This system also has a function of forcibly setting a bit rate on the basis of an external signal.

This type of speech coder/decoder will now be briefly described with reference to FIG. 11. In the illustrated speech coder/decoder, the bit rate is controlled on the basis of an-external signal.

The illustrated speech coder/decoder comprises a speech coder and a speech decoder. The speech coder and speech decoder include respective coding parameter controllers 51 and 55. In the speech coder, a bit rate is given to the coding parameter controller 51. The coding parameter controller 51 selects control parameters corresponding to the given bit rate with reference to a table (not shown, but for instance a ROM (read only memory) with bit rate addresses), in which a plurality of control parameters for controlling the operation of a CELP coder 52 are stored, and provides the selected control parameters to the CELP coder 52. The control parameters are sub-frame length as a unit of excitation signal coding in CELP coding, and bit distribution.

An input signal (i.e., input speech signal) is supplied to a CELP coder 52. The CELP coder 52 computes linear prediction coefficients, which represent a spectral envelope characteristic of the input signal, by linear prediction analysis thereof for each predetermined frame. The CELP coder 52 also generates an excitation signal by driving a linear prediction synthesis filter corresponding to the spectral envelope characteristic, and codes the excitation signal on the basis of the bit distribution. The excitation signal is coded for each of a plurality of sub-frames, into which each frame is divided.

The excitation signal noted above is constituted by a periodic component representing the pitch period of the input signal, a residue signal, and gains of these components. The periodic component representing the pitch period of the input signal, is expressed as an adaptive codevector stored-in a codebook called adaptive codebook. The residue component is expressed as a multi-pulse signal, which is disclosed in, for instance, J-P. Adoul et al, "Fast CELP Coding Based on Algebraic Coders", Proc. ICASSP, pp. 1957–1960, 1987 (Literature 2). The excitation signal is generated by weight imparting the adaptive codevector and the multi-pulse signal by gain data stored in a gain codebook and adding together the results of the weight imparting. A reproduced signal can be synthesized by driving the linear prediction synthesis filter on the basis of the excitation signal.

The selection of the adaptive codevector, multi-pulse signal and gain is controlled such as to minimize error power as a result of acoustical weight imparting of an error signal, which represents an error between the reproduced signal and the input signal. The CELP coder 52 outputs indexes corresponding to the adaptive codevector, multi-pulse signal and gain, and an index representing the linear prediction coefficients, to a multiplexer 53.

The multiplexer 53 provides a bit stream which is obtained by converting the indexes corresponding to the adaptive codevector, multi-pulse signal, gain index and linear prediction coefficients for each frame. Data representing the bit rate is stored in a bit stream header.

In the speech decoder, a multiplexer 54 receives the bit stream, extracts bit stream header data representing the bit rate, and provides the extracted bit rate data to the coding parameter controller 55. Then, the multiplexer 54 extracts the indexes corresponding to the adaptive codevector, multi-pulse signal, gain and linear prediction coefficients from the bit stream for each frame, and provides the extracted data to a CELP decoder 56.

The coding parameter controller 55 executes a similar process to that in the coding parameter controller 51, then selects the control parameters on the basis of the supplied bit rate data, and provides the selected control parameters to the CELP decoder 56.

The CELP decoder 56 executes a decoding process using the indexes corresponding to the adaptive codevector, multi-pulse signal, gain and linear prediction coefficients as well as the sub-frame length and bit rate data. The excitation signal is obtained by weight imparting the adaptive codevector and multi-pulse signal with gain data held in the gain codebook and adding together the results of the weight imparting. In the CELP decoder 56, the reproduced signal is obtained by driving the linear prediction synthesis filter on the basis of the excitation signal.

As shown above, in the CELP coding system the bit rate is controlled by controlling the sub-frame length as a unit of excitation signal coding and the bit distribution.

In the prior art speech coder/decoder, however, the frame length as a unit of coding is fixed. Therefore, it is impossible to control coding delay, which is defined as time from the instant when a first input signal sample is supplied till the instant of start of the coding.

In addition, in the prior art coder/decoder it is necessary to provide in advance parameters which are necessary for generating the multi-pulse signal. Therefore, the system can serve its function only when a predetermined bit rate is given.

SUMMARY OF THE INVENTION

An object of the present invention therefore is to provide a speech coder comprising a speech coding means for determining an input speech signal excitation signal expressed in the form of a plurality of pulses such as to minimize the distortion, with respect to the input speech signal, of a reproduced speech signal obtained by exciting a linear prediction synthesis filter, which is prescribed by linear prediction coefficients of the input speech signal, on the basis of the excitation signal, and a control circuit for generating control parameters on the basis of designated control data, the speech coding means serving to code the input speech signal on the basis of the control parameters.

According another aspect of the present invention, there is provided a speech coder comprising a speech coding means for determining an input speech signal excitation signal expressed in the form of a plurality of pulses such as to minimize the distortion, with respect to the input speech signal, of a reproduced speech signal obtained by exciting a linear prediction synthesis filter, which is prescribed by linear prediction coefficients of the input speech signal, on the basis of the excitation signal, and a control circuit for receiving a designated bit rate and a coding delay as control data and generating control parameters on the basis of the control data, the speech coding means serving to code the input speech signal on the basis of the control parameters.

According to other aspect of the present invention, there is provided a speech coder comprising a speech coding means for determining an input speech signal excitation signal expressed in the form of a multi-pulse signal constituted by a plurality of pulses such as to minimize the distortion, with respect to the input speech signal, of a reproduced speech signal obtained by exciting a linear prediction synthesis filter, which is prescribed by linear prediction coefficients of such input speech signal, on the basis of the excitation signal, a control circuit, supplied with the designated bit rate and coding delay as control data, for generating control parameters on the basis of the control data, the speech coding means serving to code the input speech signal on the basis of the control parameters, a control circuit for receiving a designated bit rate and a coding delay as control data and generating control parameters on the basis of the control data, the speech coding means serving to code the input speech signal on the basis of the control parameters, and a parameter setting circuit for setting parameters necessary from coding the multi-pulse signal as setting parameters on the basis of predetermined ones of the control parameters, the predetermined control parameters being supplied to the parameter setting circuits, the speech coding means serving to code the input speech signal on the basis of the control parameters and the setting parameters.

According an aspect of the present invention there is provided a speech coder comprising a speech coding means for determining an input speech signal excitation signal expressed in the form of a plurality of pulses such as to minimize the distortion, with respect to the input speech signal, of a reproduced speech signal obtained by exciting a linear prediction synthesis filter, which is prescribed by linear prediction coefficients of the input speech signal, on the basis of the excitation signal, and a control circuit for receiving a designated bit rate, a coding delay and a computational effort extent as control data and generating control parameters on the basis of the control data, the speech coding means serving to code the input speech signal on the basis of the control parameters.

According another aspect of the present invention, there is provided a speech coder comprising a speech coding means for determining an input speech signal excitation signal expressed in the form of a multi-pulse signal constituted-by a plurality of pulses such as to minimize the distortion, with respect to the input speech signal, of a reproduced speech signal obtained by exciting a linear prediction synthesis filter, which is prescribed by linear prediction coefficients of such input speech signal, on the basis of the excitation signal, a control circuit, supplied with the designated bit rate, coding delay and computation amounts as control data, for generating control parameters on the basis of the control data, the speech coding means serving to code the input speech signal on the basis of the control parameters, a control circuit for receiving a designated bit rate and a coding delay as control data and generating control parameters on the basis of the control data, the speech coding means serving to code the input speech signal on the basis of the control parameters, and a parameter setting circuit for setting parameters necessary from coding the multi-pulse signal as setting parameters on the basis of predetermined ones of the control parameters, the predetermined control parameters being supplied to the parameter setting circuits, the speech coding means serving to code the input speech signal on the basis of the control parameters and the setting parameters.

According to other aspect of the present invention, there is provided a speech decoder for restoring a reproduced speech signal from received coded speech data, the coded speech data including a speech signal excitation signal, linear prediction-synthesis filter coefficients and control data, comprising a control circuit for generating control parameters on the basis of the control data, and speech decoding means for restoring a reproduced speech signal by restoring the excitation signal and the linear prediction synthesis filter coefficient by decoding from the coded speech data on the basis of the control parameters and exciting a linear prediction synthesis filter, which is prescribed by the linear prediction synthesis filter coefficient, on the basis of the excitation signal.

According to further aspect of the present invention, there is provided a speech decoder for restoring a reproduced speech signal from received coded speech data, the coded speech data including a speech signal excitation signal, linear prediction synthesis filter coefficients, bit rate and coding delay, comprising a control circuit for generating control parameters on the basis of the bit rate and coding delay, and speech decoding means for restoring a reproduced speech signal by restoring the excitation signal and the linear prediction synthesis filter coefficient by decoding from the coded speech data on the basis of the control parameters and exciting a linear prediction synthesis filter, which is prescribed by the linear prediction synthesis filter coefficient, on the basis of the excitation signal.

According still further aspect of the present invention, there is provided a speech decoder for restoring a reproduced speech signal from received coded speech data, the coded speech data including a speech signal excitation signal, linear prediction synthesis filter coefficients, a bit rate and a coding delay, the excitation signal being expressed in the form of a multi-pulse constituted by a plurality of pulses, the speech decoder comprising a control circuit for generating control parameters on the basis of the bit rate and the coding delay, a parameter setting circuit for setting parameters necessary for coding the multi-pulse as setting parameters on the basis of predetermine ones of the control parameters, and speech decoding means for restoring a reproduced speech signal by restoring the excitation signal and the linear prediction synthesis filter coefficient by decoding from the coded speech data on the basis of the control parameters and the setting parameters and exciting a linear prediction synthesis filter, which is prescribed by the linear prediction synthesis filter coefficient, on the basis of the excitation signal.

According to the present invention, there is provided a speech coding method comprising of computing frame length from bit rate and coding delay, selecting control parameters from a table in which a plurality of control parameters for controlling an operation of CELP coding on the basis of the bit rate, computing pulse number of multi-pulse excitation signal, pulse position candidates of each pulse and candidate positions thereof from the sub-frame length and bit number of multi-pulse signal.

According to other aspect of the present invention, there is provided a speech coding method comprising dividing an input speech signal into frames on the basis of a given frame length, generating control parameters of frame length, sub-frame length and bit distribution that are necessary for coding, from given bit rate and coding delay data, and setting parameters necessary for generating a multi-pulse signal from the given bit rate and coding delay.

In the present invention, the speech coder comprises a coding parameter control circuit for generating control parameters, i.e., frame length, sub-frame length and bit distribution that are necessary for the coding, from given bit rate and coding delay data. The input speech signal is divided into frames on the basis of the given frame length. A multi-pulse signal coding parameter setting circuit sets parameters, which are necessary for generating a multi-pulse signal from the given bit rate and coding delay.

Since the coding parameter control circuits generates the frame length, sub-frame length and bit distribution data, and the input speech signal is divided into frames on the basis of the generated frame length, it is possible to vary the frame length which is a unit of processing for the coding. It is thus possible to control the coding delay in addition to the bit rate.

Since the multi-pulse signal coding parameter setting circuit sets parameters necessary for the multi-pulse signal generation, it is possible to increase the bit rate range. That is, it is not necessary to set a bit rate in advance.

Other objects and features will be clarified from the following description with reference to attached drawings.

PREFERRED EMBODIMENTS OF THE INVENTION

Figure 1:
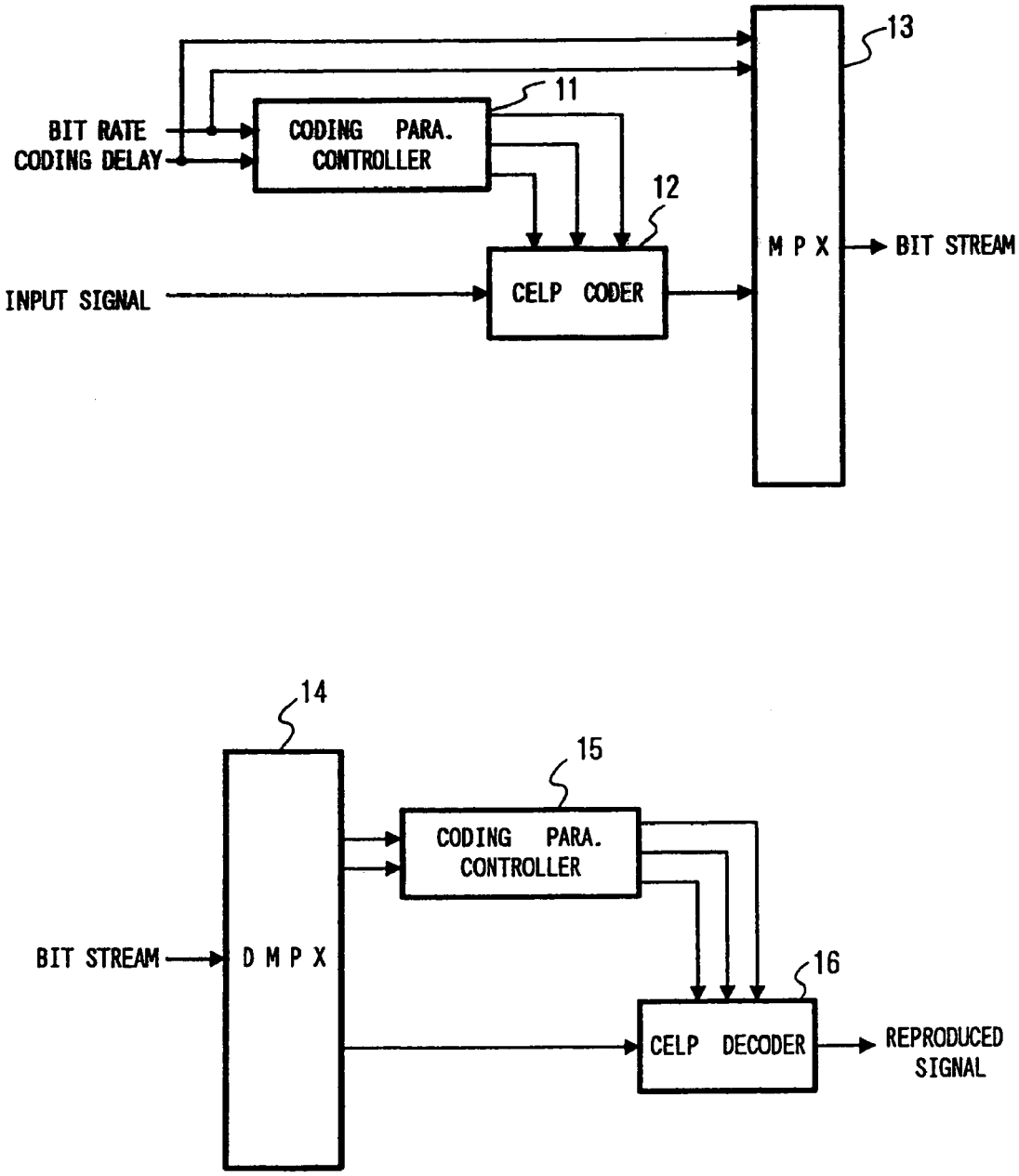
FIG. 1 is a block diagram of a speech coder/decoder according to a first embodiment of the present invention.

Referring to FIG. 1, a speech coder/decoder is shown, which comprises a speech coder and a speech decoder. The speech coder includes a coding parameter control circuit 11, a CELP coding circuit 12 and a multiplexer 13. The speech decoder includes a demultiplexer 14, a coding parameter control circuit 15 and a CELP decoding circuit 16.

In the speech coder, bit rate and coding delay are given as control data to the coding parameter control circuit 11. The coding parameter control circuit 11 calculates a frame length by subtracting an advance read length, which is necessary for an analytic processing in CELP coding, from the given bit rate and coding delay. For example, in a case where the coding delay is 25 ms and the advance read length of the linear prediction analysis is 5 ms, the frame length is 20 ms.

The coding parameter control circuit 11 selects, on the basis of the given bit rate, control parameters from a table, in which a plurality of control parameters for controlling the operation of the CELP coding circuit 12 are set on the basis of calculated frame length, and provides the selected control parameters to the CELP coding circuit 12. The selected control parameters are frame length, sub-frame length (of 5 ms, for instance) and bit distribution. The CELP coding circuit 12 codes the input signal (input speech signal) on the basis of frame length, sub-frame length and bit distribution that have been set.

Figure 2:
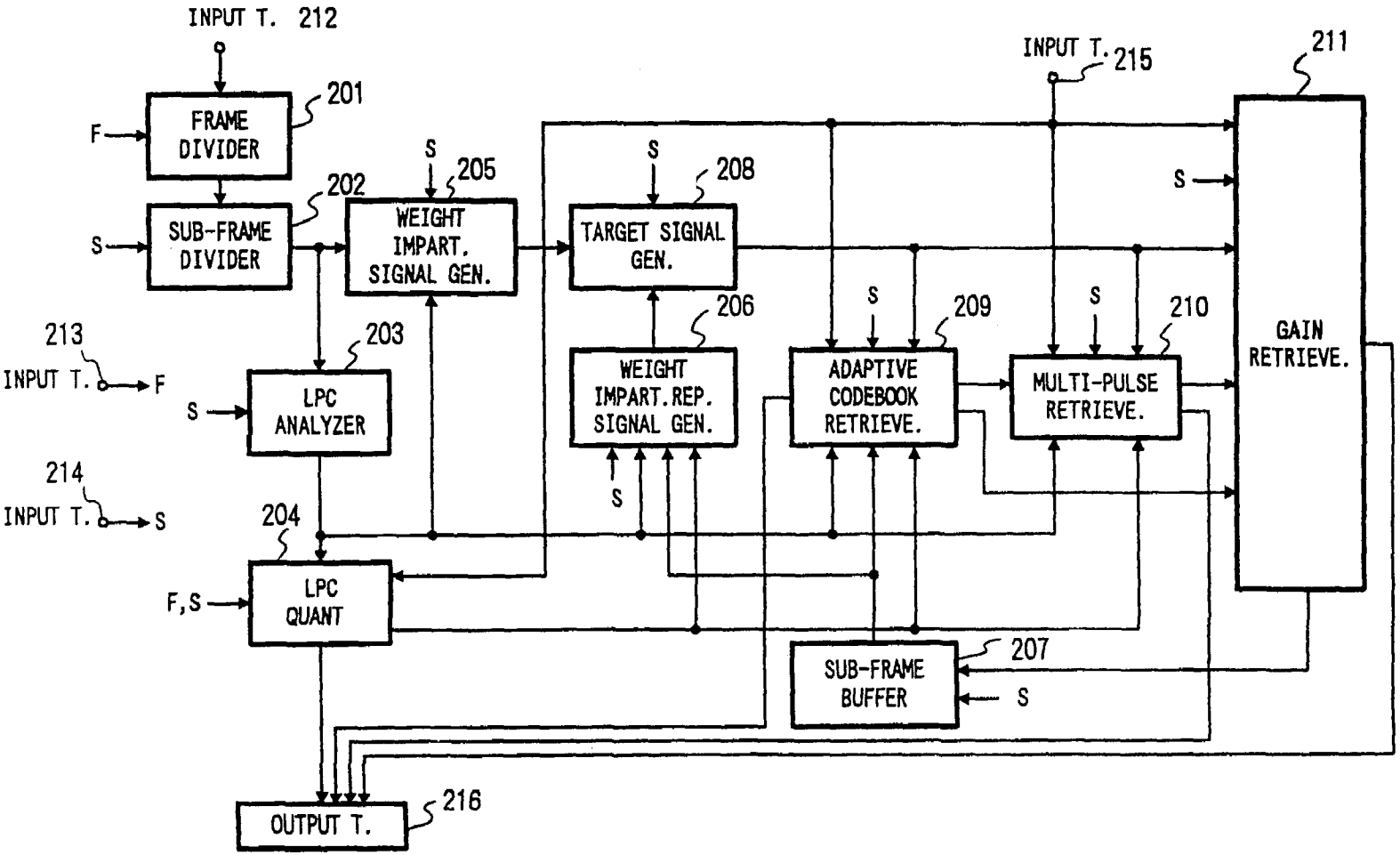
FIG. 2 is a block diagram for explaining the CELP coding circuit shown in FIG. 1.

The operation of the CELP coding circuit 12 will now be described by having reference also to FIG. 2.

The frame length F that has been set in the coding parameter control circuit 11, is supplied through an input terminal 213 to a frame dividing circuit 201 and a linear prediction coefficient quantizing circuit 204.

The sub-frame length S that has also been set in the coding parameter control circuit 11, is supplied through an input terminal 214 to a sub-frame dividing circuit 202, a linear prediction analysis circuit 203, the linear prediction coefficient quantizing circuit 204, an acoustical weight imparting signal generating circuit 205, an acoustical weight imparted reproduced signal generating circuit 206, a target signal generating circuit 208, an adaptive codebook retrieving circuit 209, a multi-pulse retrieving circuit 210 and a gain retrieving circuit 211.

The bit distribution to the parameters having been set in the coding parameter control circuit 11, is supplied through an input terminal 215 to the linear prediction coefficient quantizing circuit 204, adaptive codebook retrieving circuit 209, multi-pulse retrieving circuit 210 and gain retrieving circuit 211.

The frame dividing circuit 201 divides the input signal on the basis of the frame length F having been set, and provides each frame of input signal to the sub-frame dividing circuit 202.

The sub-frame dividing circuit 202 divides each frame on the basis of the sub-frame length S having been set, and provides each sub-frame of input signal to the linear prediction analysis circuit 203 and acoustical weight imparting signal providing circuit 205.

The linear prediction analysis circuit 203 executes linear prediction analysis of signal (sub-frame signal) provided from the sub-frame dividing circuit 202 on the basis of the sub-frame length S having been set for each sub-frame, and provides linear prediction coefficients a(i) (i=1, . . . , Np) to the linear prediction coefficient quantizing circuit 204, acoustical weight imparting signal providing circuit 205, acoustical weight imparted reproduced signal generating circuit 206, adaptive codebook retrieving circuit 209 and multi-pulse retrieving circuit 210. Np is the degree number of the linear prediction analysis, for instance 10. The linear prediction analysis may be a self-correlation process or a covariance process, and is detailed in Furui, "Digital Speech Processing", Tokai University Publishing Association (Literature 3).

The linear prediction coefficient quantizing circuit 204 executes collective quantization of the linear prediction coefficients obtained for the individual sub-frames on the basis of the frame length F and sub-frame length S having been set for each frame. In order to reduce the bit rate, this quantization is executed for only the last sub-frame in the frame and using interpolated values of the quantized values of the pertinent and immediately preceding frames as the quantized values of the other sub-frames. This quantization and interpolation are executed after conversion of the linear prediction coefficient into corresponding line spectrum pair (LSP). The conversion of the linear prediction coefficient into LSP is described in, for instance, Sugamura et al, "Speech Data Compression in Linear Spectrum Pair (LSP) Speech Analysis Synthesis Systems", The Transactions of Institute of Electronics and Communication Engineers of Japan, J64-A, pp. 599–606, 1981 (Literature 4). The LSP quantization may be executed in a well-known manner; for instance, it is disclosed in Japanese Laid-Open Patent Publication No. 4-171500 (Literature 5), and it is not described here. The linear prediction coefficient quantizing circuit 204 converts the quantized LSP into corresponding linear prediction coefficients, and provides the result as quantized linear prediction coefficient a'(i) (i=1, . . . , Np) to the acoustical weight imparting signal providing circuit 205, acoustical weight imparted reproduced signal generating circuit 206, an adaptive codebook retrieving circuit 209 and multi-pulse retrieving circuit 210.

An index representing the quantized LSP is supplied through an output terminal 216 to the multiplexer 13. Linear prediction synthesis filter Hs(z) is expressed by formula (1).

$$Hs(z) = \frac{1}{1 - \sum_{i=1}^{Np} a'(i)z^{-i}} \tag{1}$$

In the acoustical weight imparting signal generating circuit 205, an acoustical weight imparting filter Hw(z) expressed by formula (2) is formed using the linear prediction coefficients, and is driven by sub-frame input signal to generate an acoustical weight imparted signal. This acoustical weight imparted signal is provided to the target signal generating circuit 208.

$$Hw(z) = \frac{1 - \sum_{i=1}^{Np} a(i)R2^i z^{-i}}{1 - \sum_{i=1}^{Np} a(i)R1^i z^{-i}} \tag{2}$$

where R1 and R2 are weight imparting coefficients to control the extent of the acoustical weight imparting and, for instance, R1=0.6 and R2=0.9.

The acoustical weight imparted reproduced signal generating circuit 206 drives the linear prediction synthesis filter and the acoustical weight imparting synthesis filter of the preceding frame with the excitation signal of the preceding sub-frame which is obtained through a sub-frame buffer 207, and provides data representing the states of the two filters after the driving to the target signal generating circuit 208.

The target signal generating circuit 208 receives the data representing the states of the linear prediction synthesis filter and acoustical weight imparting filter from the acoustical weight imparting reproduced signal generating circuit 206, generates a zero input response of a filter which is constituted by the two filters connected in cascade, subtracts the zero input response thus generated from the acoustical weight imparted signal, and provides the resultant difference as the target signal to the adaptive codebook retrieving circuit 209 and multi-pulse retrieving circuit 210 as well as to a gain retrieving circuit 211.

The adaptive codebook retrieving circuit 209 updates a codebook, called adaptive codebook and holding past excitation signals, on the basis of the excitation signal of the immediately preceding sub-frame that is obtained through the sub-frame buffer 207, and then selects an adaptive codevector corresponding to pitch d from the adaptive codebook. When the pitch d is shorter than the sub-frame length, an adaptive codevector is formed by repeatedly connecting excitation signal segments each corresponding to delay d, separated one after another from past excitation signal stored in the adaptive codebook, until reaching of the sub-frame length. The reproduced signal SAd(n) is formed by driving the linear prediction synthesis filter and acoustical weight imparting filter in zero states thereof with the adaptive codevector Ad(n) thus formed, and selects pitch d which minimizes the error Ed between the target signal X(n) and the reproduced signal SAd(n), given by formula (3).

$$Ed = \sum_{n=1}^{L} X^2(n) - \frac{\left(\sum_{n=1}^{L} X(n)SAd(n)\right)^2}{\sum_{n=1}^{L} SAd^2(n)} \tag{3}$$

where L is the sub-frame length set by the coding parameter control circuit 11. The adaptive codebook retrieving circuit 209 further provides the selected pitch d through the output terminal 216 to the multiplexer 13, and also provides the selected adaptive codevector Ad(n) and the reproduced signal SAd(n) thereof to the gain retrieving circuit 211. The adaptive codebook retrieving circuit 209 provides the reproduced signal SAd(n) to the gain retrieving circuit 211 and provides the reproduced signal SAd(n) to the multi-pulse retrieving circuit 210.

The multi-pulse retrieving circuit 210 forms a multi-pulse signal constituted by a plurality of non-zero pulses. The position of each pulse is selected from a plurality of pulse position candidates predetermined for each pulse. Each pulse is a polarity pulse. For example, in 8-kHz sampling with a sub-frame length of 5 ms (i.e., with a sample number N of 40), the multi-pulse excitation signal is constituted by P (for instance 5) pulses. The position of each of the P pulses is selected from M(p) (p=1, . . . , P−1, for instance 8) pulse position candidates. The multi-pulse retrieving circuit 210 is holding a plurality of combinations of pulse number P and M(p) pulse position candidates, and selects a combination of pulse number P and M(p) pulse position candidates on the basis of a bit distribution designated by a coding parameter control circuit 11. The multi-pulse retrieving circuit 210 also forms multi-pulse signal Cj(n) by using the selected pulse number P (equal to the number of channels) and M pulse position candidates of each channel, and selects a multi-pulse signal Cj(n) which minimizes formula (4).

$$Ej = \sum_{n=1}^{L} X'^2(n) - \frac{\left(\sum_{n=1}^{L} X'(n)SCj(n)\right)^2}{\sum_{n=1}^{L} SCj^2(n)} \quad (4)$$

where X' (n) is a subtracted signal of the reproduced signal SA(n) of the adaptive codevector from the target signal X(n) and given by formula (5).

$$X'(n) = X(n) - \frac{\sum_{n=1}^{L} X(n)SAd(n)}{\sum_{n=1}^{L} SAd^2(n)} SAd(n) \quad (5)$$

Formula (4) can be minimized with reducing the computational effort extent, for instance by using method as described in Japanese Patent Application No. 7-318071 (Literature 6). The multi-pulse retrieving circuit 210 provides the selected multi-pulse signal Cj(n) and reproduced signal SCj(n) thereof to the gain retrieving circuit 211, and provides corresponding index j through the output terminal 216 to the multiplexer 13. The gain retrieving circuit 211 quantizes the gains GA and GC by using the reproduced signal SAd(n) of the adaptive codevector, reproduced signal SCj(n) of the multi-pulse signal and target signal X(n) such as to minimize formula (6).

$$Ek = \sum_{n=1}^{L} (X(n) - Gk(1)SAd(n) - Gk(2)SCj(n)^2 \quad (6)$$

The gain retrieving circuit 211 further forms an excitation signal by using the quantized gain, adaptive codevector and multi-pulse signal, provides the excitation signal thus formed through the sub-frame buffer 207 to the acoustical weight imparted reproduced signal generating circuit 206 and adaptive codebook retrieving circuit 209, and an index corresponding to the gain through the output terminal 216 to the multiplexer 13.

Referring now back to FIG. 1, the multiplexer 13 provides a bit stream obtained by conversion from the indexes representing the quantized LSP, pitch, multi-pulse signal and quantized gains for each signal. The bit rate and coding delay data are provided in a header of the bit stream.

In the speech decoder, the bit stream is supplied to the demultiplexer 14. The demultiplexer 14 provides the bit rate and coding delay data present in the bit stream header to the coding parameter control circuit 15, and then it extracts the indexes of the quantized LSP, pitch, multi-pulse signal and quantized gains from the bit stream for each frame, and provides them to the CELP decoding circuit 16.

The coding parameter control circuit 15 executes an operation similar to that in the coder side coding parameter control circuit 11; i.e., it selects control parameters on the basis of the input bit rate and coding delay data, and provides the selected control parameters to the CELP decoding circuit 16.

Figure 3:
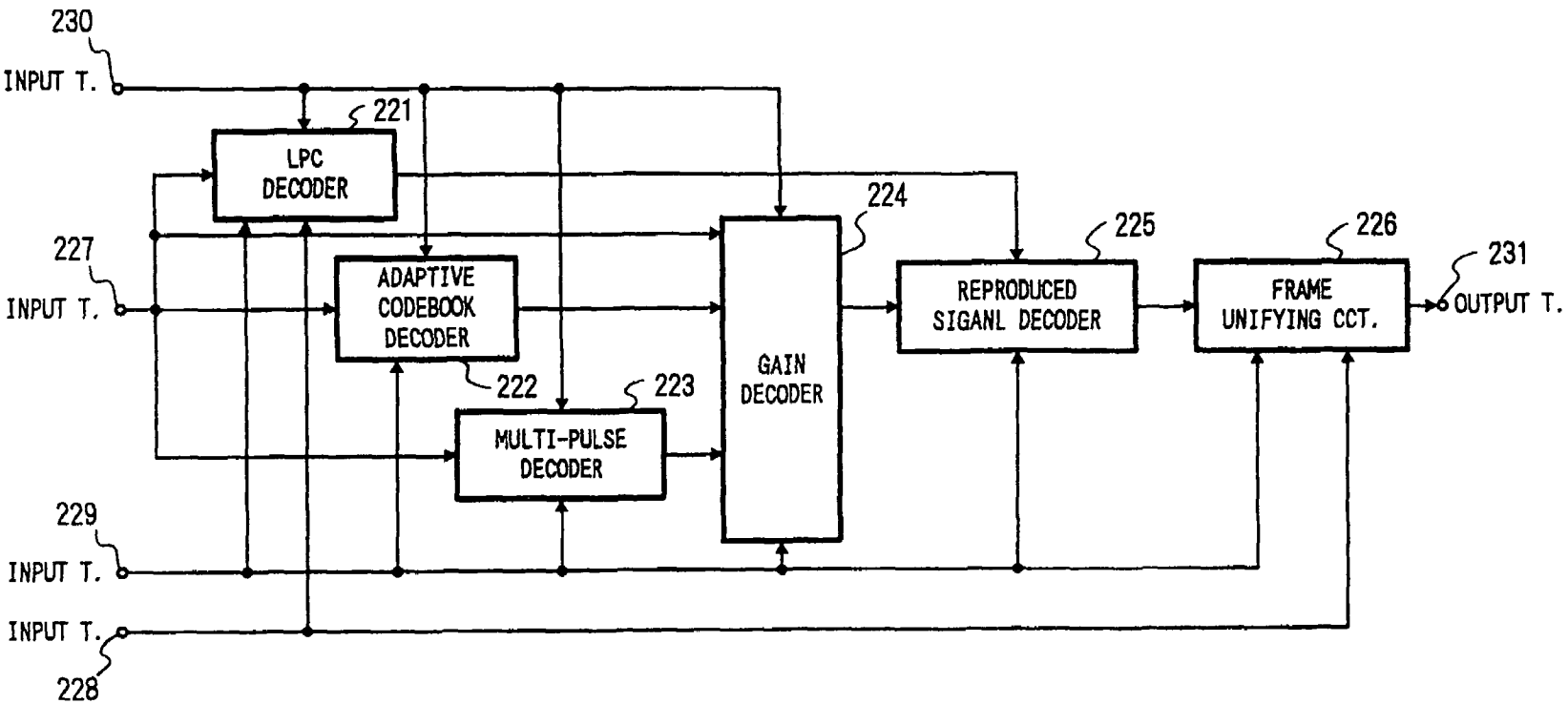
FIG. 3 is a block diagram for explaining the CELP decoding circuit shown in FIG. 1.

The operation of the CELP decoding circuit will now be described by having reference also to FIG. 3.

The indexes representing the quantized LSP, pitch, multi-pulse signal and quantized gains, are supplied through an input terminal 227 to a linear prediction coefficient decoding circuit 221, an adaptive codebook decoding circuit 222, a multi-pulse signal decoding circuit 223 and a gain decoding circuit 224.

The frame length data set by the coding parameter control circuit 15 is supplied through an input terminal 228 to the linear prediction coefficient decoding circuit 221 and a frame unifying circuit 226.

The sub-frame length data set by the coding parameter control circuit 15 is supplied through an input terminal 229 to the linear prediction coefficient-decoding circuit 221, adaptive codebook decoding circuit 222, multi-pulse signal decoding circuit 223 and gain decoding circuit 224 and also to a reproduced signal synthesizing circuit 225 and the frame unifying circuit 226.

The bit distribution data set by the coding parameter control circuit 15 is supplied through an input terminal 230 to the linear prediction coefficient decoding circuit 221, adaptive codebook decoding circuit 222, multi-pulse signal decoding circuit 223 and gain decoding circuit 224.

The linear prediction coefficient decoding circuit 221 receives the index representing the quantized LSP for each frame, and provides quantized linear prediction coefficient a' (i) (i=1, . . . , Np) restored by decoding for each sub-frame to the reproduced signal synthesizing circuit 225.

The adaptive codebook decoding circuit 222 restores the adaptive codevector by decoding from the pitch data supplied for each sub-frame. The multi-pulse decoding circuit 223 provides the multi-pulse signal restored by decoding from the indexes supplied for each sub-frame to the gain decoder 224.

The gain decoding circuit 224 restores the gains by decoding from the indexes supplied for each sub-frame, forms an excitation signal by using the adaptive codevector, multi-pulse signal and gains, and provides the excitation signal thus formed to the reproduced signal synthesizing circuit 225.

The reproduced signal synthesizing circuit 225 forms a reproduced signal by driving the linear prediction synthesis filter Hs(z) with the excitation signal for each sub-frame, and provides the reproduced signal thus formed to the frame unifying circuit 226. The linear prediction synthesis filter Hs(z) is expressed by formula (1) noted above. The frame unifying circuit 226 connects together successively supplied sub-frame reproduced signals for the frame length, and provides the resultant reproduced signal for each frame.

Figure 4:
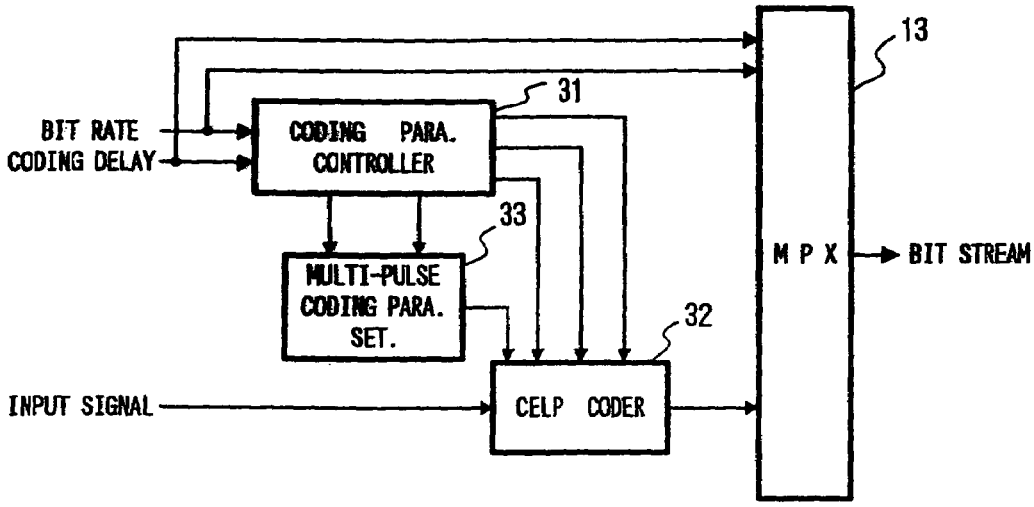
FIG. 4 is a block diagram of a speech coder/decoder according to a second embodiment of the present invention.
Figure 4:
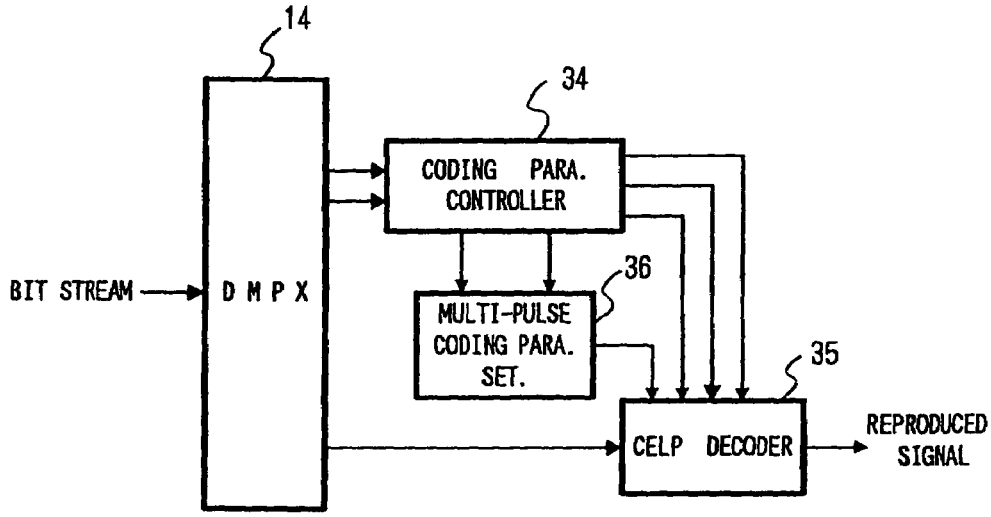

A different embodiment of the speech coder/decoder according to the present invention will now be described with reference to FIG. 4.

The illustrated coder/decoder comprises a speech coder and a speech decoder. The speech coder includes a coding parameter control circuit 31, a CELP coding circuit 32, a multi-pulse signal coding parameter setting circuit 33 and a multiplexer 13. The speech decoder includes a demultiplexer 14, a coding parameter setting circuit 34, a CELP decoding circuit 35 and a multi-pulse signal coding parameter setting circuit 16.

In the speech coder, the coding parameter control circuit 31 receives the bit rate and coding delay as control data, and calculates the frame length by subtracting advance read length, which is necessary for an analysis process in CELP coding, from the given bit rate and coding delay. On the basis of the calculated frame length, the coding parameter control circuit 31 selects control parameters from a table, in which a plurality of control parameters for controlling the operation of the CELP coding circuit 32 are stored, on the basis of the supplied bit rate, and provides the selected control parameters to the CELP coding circuit 32. The coding parameter control circuit 31 further provides the bit number distributed to the sub-frame length and multi-pulse signal to the multi-pulse signal coding parameter setting circuit 33.

The multi-pulse signal coding parameter setting circuit 33 computes pulse number P, pulse position candidate number M(p) of each pulse and position candidates thereof, necessary for the multi-pulse excitation signal coding, from supplied sub-frame length N and bit number Y of the multi-pulse signal. The pulse position candidates of each pulse are set such that a sequence of 0, 2, 3, . . . , N−1 is interleaved with the pulse number P, as disclosed in Literature 2 noted above. For example, in a case where the sub-frame length is set to 40 (i.e., a sample number N of 40) and the bit number Y of the multi-pulse signal is set to 20, the pulse number P is 5 and the pulse position candidate number M(p) is 8. An example of pulse position candidates in this case is shown in Table 1 below.

$$Y = \sum_{p=0}^{P-1} (1 + \log_2 M(p)) \tag{7}$$

$$N = \sum_{p=0}^{P-1} M(p) \tag{8}$$

TABLE 1

| PULSE No. | PULSE POSITION CANDIDATES |
|---|---|
| 0 | 0, 5, 10, 15, 20, 25, 30, 35 |
| 1 | 1, 6, 11, 16, 21, 26, 31, 36 |
| 2 | 2, 7, 12, 17, 22, 27, 32, 37 |
| 3 | 3, 8, 13, 18, 23, 28, 33, 38 |
| 4 | 4, 9, 14, 19, 24, 29, 34, 39 |

The CELP coding circuit 32 codes the input signal on the basis of the frame length, sub-frame length and bit distribution that are set by the coding parameter control circuit 31, and also the pulse number P, pulse position candidate number M(p) of each pulse and position candidates thereof that are set by the multi-pulse signal coding parameter setting circuit 33.

The operation of the CELP coding circuit 32 will now be described with reference to FIG. 5.

The CELP coding circuit 32 is the same as the CELP coding circuit described before in connection with FIG. 2 except for the operation of the multi-pulse retrieving circuit. For this reason, only the operation of the multi-pulse retrieving circuit 401 will be described.

Figure 5:
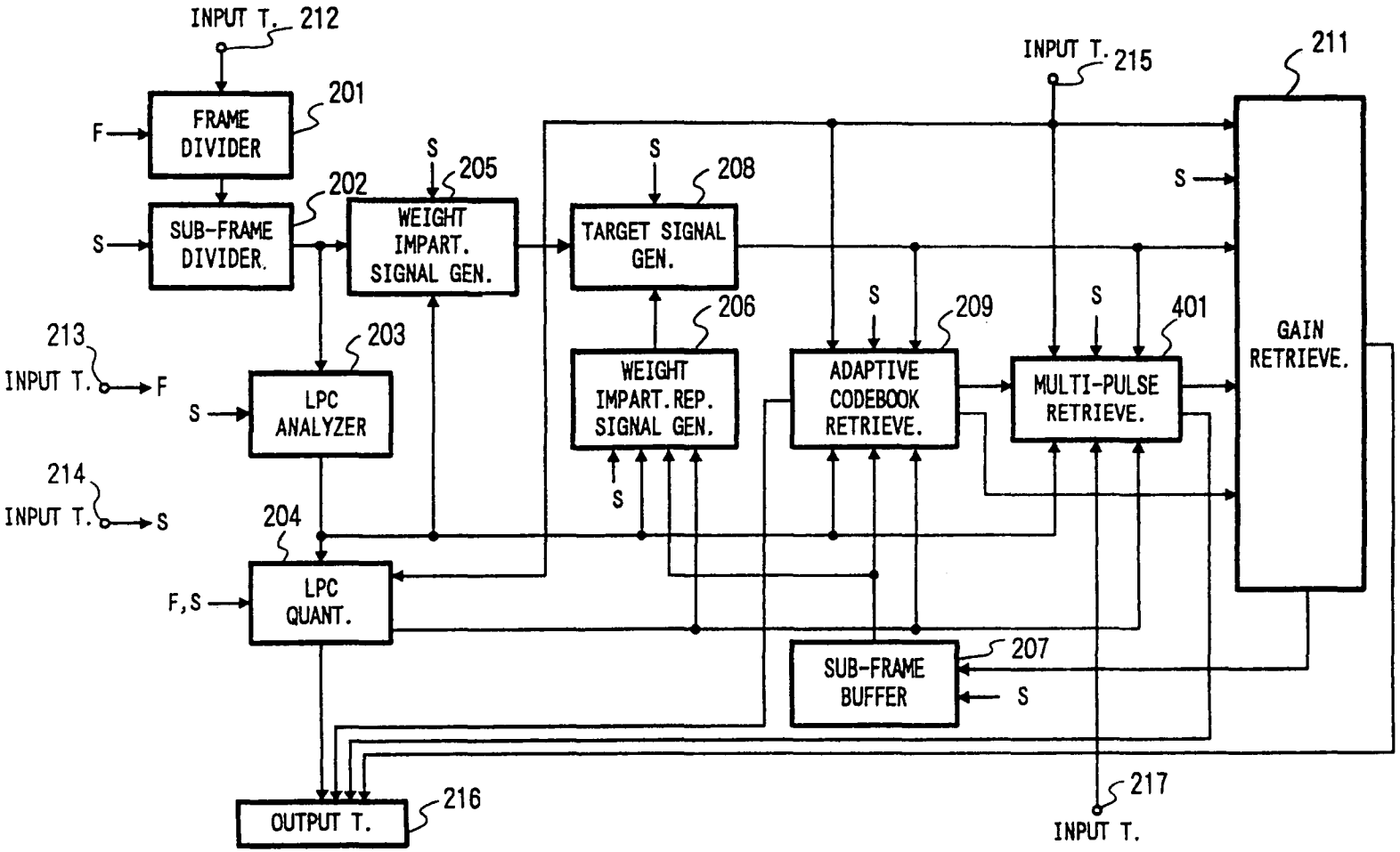
FIG. 5 is a block diagram for explaining the CELP coding circuit shown in FIG. 4.

The multi-pulse retrieving circuit, designated at 401 in FIG. 5, generates the multi-pulse signal Cj(n) on the basis of the pulse number P and M(p) pulse position candidates of each pulse, set by the multi-pulse generation parameter setting circuit 33 and supplied through an input terminal 217, and selects a multi-pulse signal Cj(n) that minimizes formula (4) noted above. As described before, in the minimization of formula (4) the computational effort extent can be reduced by using the manner described in Literature 6.

The multi-pulse retrieving circuit 401 provides the selected multi-pulse signal Cj(n) and reproduced signal SCj(n) thereof to the gain retrieving circuit 211 and also provides corresponding index j through the output terminal 216 to the multiplexer 13. As described before in connection with FIG. 1, the multiplexer 13 provides a bit stream.

Referring back to FIG. 4, in the speech decoder the bit stream is received by the demultiplexer 14. As described before in connection with FIG. 1, the demultiplexer 14 provides the bit rate and coding delay data present in the bit stream header to the coding parameter control circuit 34, then extracts the indexes representing the quantized LSP, pitch and multi-pulse signal from the bit stream for each frame, and provides the extracted indexes to the CELP decoding circuit 35.

The coding parameter setting circuit 34 executes an operation similar to that in the coding parameter control circuit 31, thus selecting the control parameters and providing the same to the CELP decoding circuit 35.

The multi-pulse coding parameter setting circuit 36 executes an operation similar to that in the coding side multi-pulse generation parameter setting circuit 33, thus computing the pulse number representing the multi-pulse excitation signal, pulse position candidate number of each pulse and position candidates thereof, and providing the computed data to the CELP decoding circuit 35.

The operation of the CELP decoding circuit 35 will now be described with reference also to FIG. 6.

The CELP decoding circuit 35 is the same as the CELP decoding circuit described before in connection with FIG. 3 except for the operation of the multi-pulse decoding circuit. For this reason, only the operation of the multi-pulse decoding circuit 402 will be described.

Figure 6:
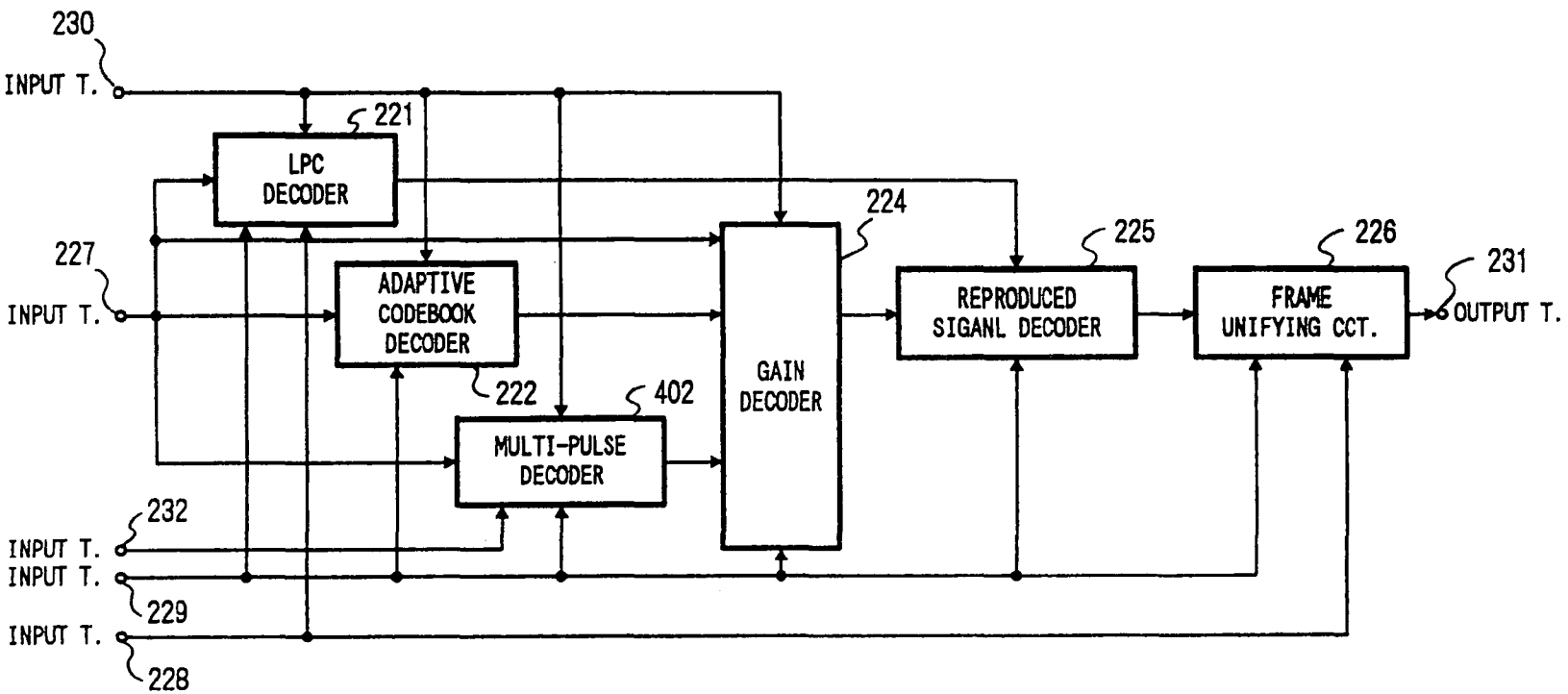
FIG. 6 is a block diagram for explaining the CELP decoding circuit shown in FIG. 4.

The multi-pulse decoding circuit, designated at 402 in FIG. 6, receives the sub-frame length set by the coding parameter control circuit 34 through the input terminal 229, receives the pulse number, pulse position candidate number of each pulse and position candidates thereof set by the multi-pulse coding parameter setting circuit 36 through an input terminal 232, and restores the multi-pulse signal by decoding from the indexes supplied for each sub-frame.

Figure 7:
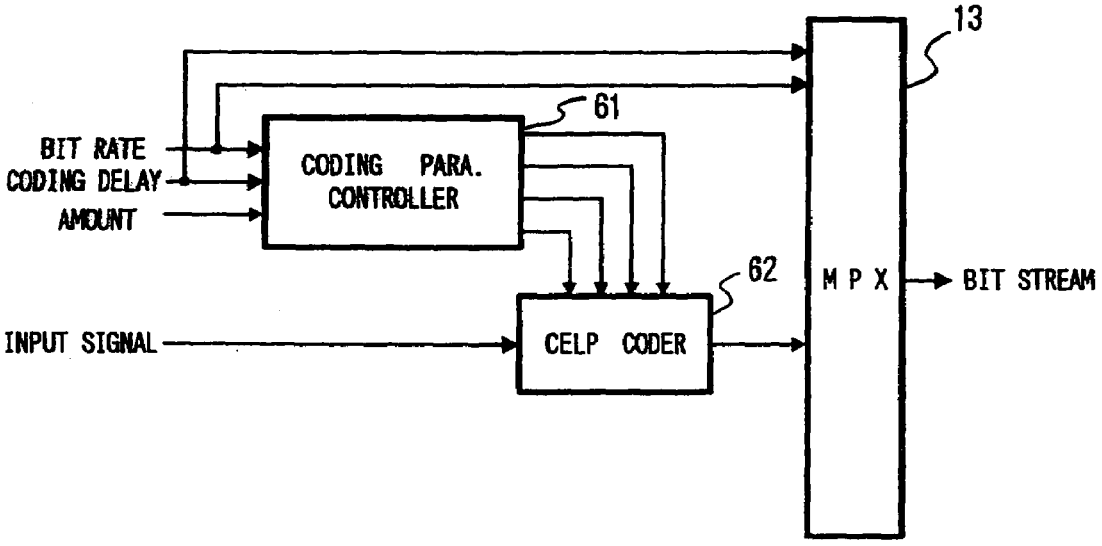
FIG. 7 is a block diagram of a speech coder/decoder according to a third embodiment of the present invention.

A further embodiment of the speech coder according to the present invention will now be described with reference to FIG. 7.

The illustrated speech coder includes a coding parameter control circuit 61, a CELP coding circuit 62 and a multiplexer 13. The coding parameter control circuit 61 executes an operation similar to that in the coding parameter control circuit 11 described before in connection with FIG. 1, thus setting the frame length, sub-frame length and bit distribution from the supplied bit rate and coding delay data. The coding parameter control circuit 61 computes permissible multi-pulse signal coding computational effort extent, to which computational effort can be paid for the multi-pulse signal coding, from the supplied computational effort extent data. This computation can be executed by storing in advance data of computational effort extents necessary for the coding of other parameters and subtracting these stored computational effort extents from the supplied computational effort extent. The coding parameter control circuit 61 provides frame length, sub-frame length, bit distribution and permissible multi-pulse coding computational effort extent as control parameters to the CELP coding circuit 62.

The CDLP coding circuit 62 codes the input signal on the basis of the supplied frame length, sub-frame length, bit distribution and permissible multi-pulse signal coding computational effort extent data.

The operation of the CELP coding circuit 62 will now be described by having reference also to FIG. 8.

The CELP coding circuit 62 is the same as the CELP coding circuit described before in connection with FIG. 2 except for the operation of the multi-pulse retrieving circuit. For this reason, only the multi-pulse retrieving circuit will be described.

Figure 8:
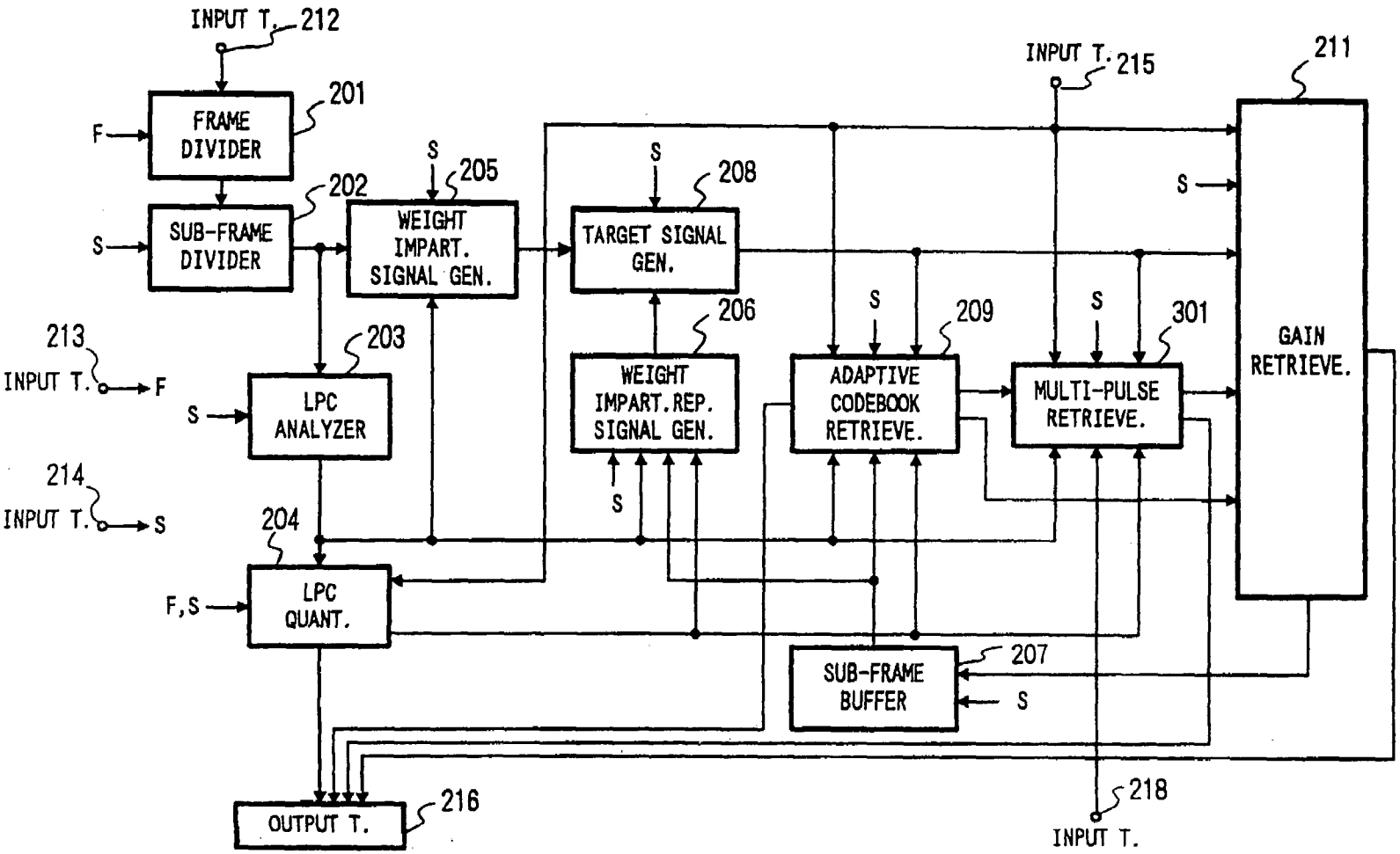
FIG. 8 is a block diagram for explaining the CELP coding circuit shown in FIG. 7.

The multi-pulse retrieving circuit, designated at 301 in FIG. 8, executes an operation similar to that in the multi-pulse retrieving circuit 210 described before in connection with FIG. 2, thus selecting a multi-pulse signal Cj(n) that minimizes formula (4) noted above. In this case, the computational effort paid for the coding of the multi-pulse signal, is preliminarily selected such that it does not exceed the permissible multi-pulse coding computational effort extent data supplied through an input terminal 218. This preliminary selection can be realized by selection of a high value of El given by formula (9).

$$E1 = \left(\sum_{n=1}^{L} X(n)SCj(n)\right)^2 \tag{9}$$

The multi-pulse retrieving circuit 301 provides the selected multi-pulse signal Cj(n) and reproduced signal SCj(n) thereof to the gain retrieving circuit 211, and also provides corresponding index j through the output terminal 216 to the multiplexer 13.

Figure 9:
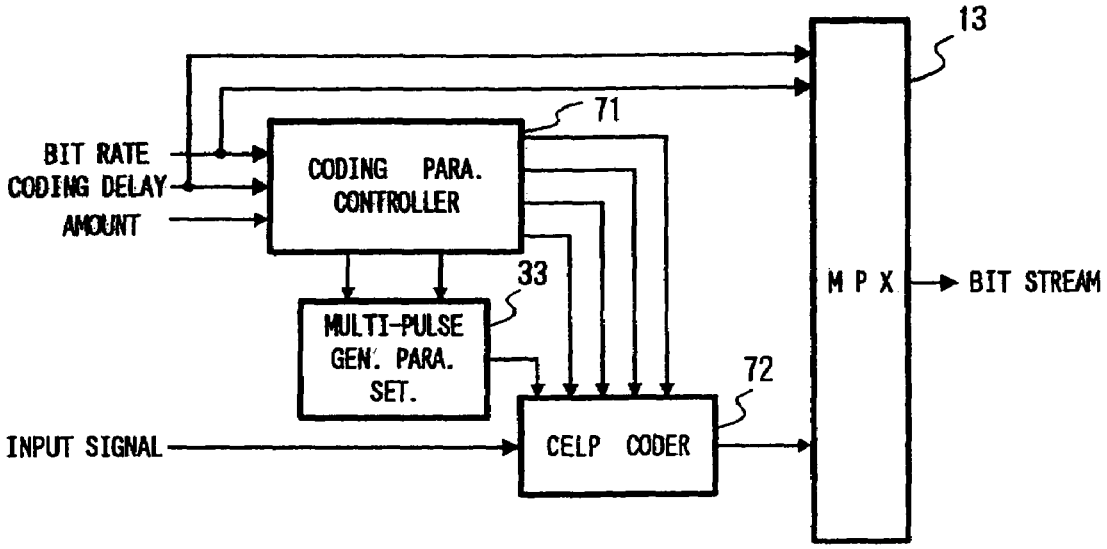
FIG. 9 is a block diagram of a speech coder/decoder according to a fourth embodiment of the present invention.

A still further embodiment of the speech coder according to the present invention will now be described with reference to FIG. 9.

The illustrated speech coder includes a coding parameter control circuit 71, a multi-pulse generation parameter setting circuit 33, a CELP coding circuit 72 and a multiplexer 13.

The coding parameter control circuit 71 executes an operation similar to that in the coding parameter control circuit 31 described before in connection with FIG. 4, thus setting frame length, sub-frame length and bit distribution from the supplied bit rate and coding delay data. The coding parameter control circuit 71 computes permissible multi-pulse signal coding computational effort extent, which is paid for the coding of multi-pulse signal, from the supplied computational effort extent data. The coding parameter control circuit 71 provides the frame length, sub-frame length, bit distribution and permissible multi-pulse signal coding computational effort extent to the CELP coding circuit 72. The coding parameter control circuit 71 provides sub-frame length and bit number distributed to the multi-pulse signal to the multi-pulse generation parameter setting circuit 33.

The CELP coding circuit 72 codes the input signal on the basis of the frame length, sub-frame length, bit distribution and permissible multi-pulse signal coding computational effort extent set by the coding parameter setting circuit 71 and the pulse number P, pulse position candidate number M(p) of each pulse and position candidates thereof set by the multi-pulse signal generation parameter setting circuit 33.

The operation of the CELP coding circuit 72 will now be described by having reference also to FIG. 10.

The CELP coding circuit 72 is the same as the CELP coding circuit described before in connection with FIG. 5 except for the operation of the multi-pulse retrieving circuit. For this reason, only the operation for the multi-pulse retrieving circuit 501 will be described.

Figure 10:
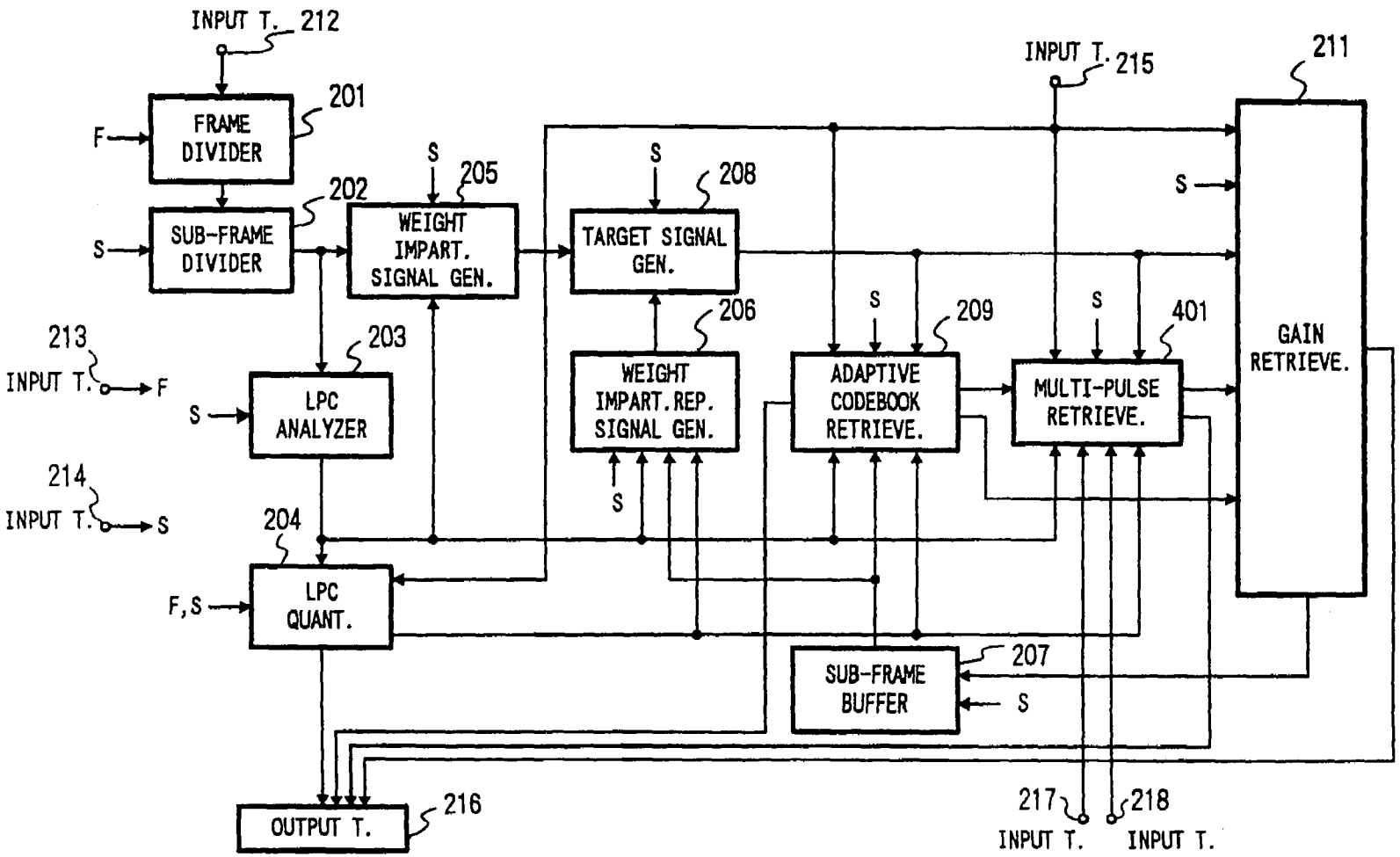
FIG. 10 is a block diagram for explaining the CELP coding circuit shown in FIG. 9.
Figure 11:
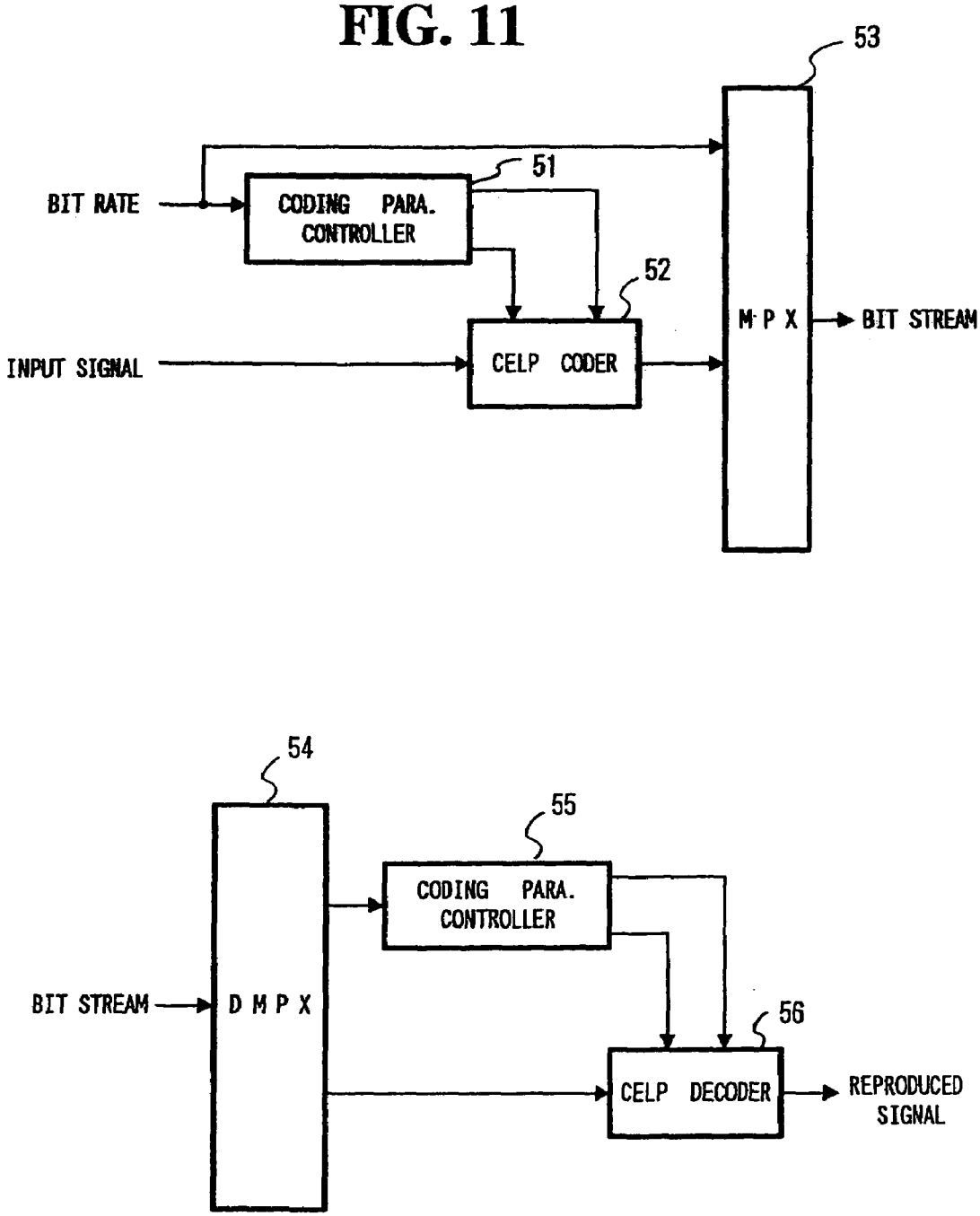
FIG. 11 is a block diagram of a prior art speech coder/decoder.

The multi-pulse retrieving circuit, designated at 501 in FIG. 10, executes an operation similar to that in the multi-pulse retrieving circuit 401 described before in connection with FIG. 5, thus selecting a multi-pulse signal CJ(n) that minimizes Formula (4) noted above. In this case, the computational effort paid for the coding of multi-pulse signal, is preliminarily set such that it does not exceed permissible multi-pulse signal coding computational effort extent supplied through an input terminal 218. The multi-pulse retrieving circuit 501 also provides the selected multi-pulse signal Cj(n) and reproduced signal SCj(n) thereof to the gain retrieving circuit 211, and also provide corresponding index j through the output terminal 216 to the multiplexer 13.

As has been described in the foregoing, according to the present invention the frame length as a unit of processing for coding is made variable, permitting generation of parameters necessary for the coding of multi-pulse signal from given bit rate and coding delay data. Thus, it is possible to control not only the bit rate but also the coding delay and computational effort. According to the present invention, it is thus possible to use the same coder/decoder when it is desired to make the coding delay to be as short as possible for a television conference system or the like or when it is desired to make the bit rate to be as low as possible rather than the coding delay for speech mail or like purposes. This permits scale reduction of the coder/decoder.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A speech coder comprising:

a control circuit which is effective to receive a coding delay and a designated bit rate as control data and which generates control parameters on the basis of the coding delay and the designated bit rate; and a speech coding circuit which codes an input speech signal, on the basis of said control parameters, into an input excitation signal, the coding performed so as to minimize distortion of a reproduced speech signal with respect to the input speech signal, the reproduced speech signal obtained by exciting a linear prediction synthesis filter prescribed by a set of linear prediction coefficients of the input speech signal, wherein the coding delay is a time from when the input speech signal is received until a start of coding.

2. The speech coder as claimed in claim 1, wherein said control parameters include frame length and subframe length.

3. The speech coder as claimed in claim 1, wherein said control circuit generates said control parameters based on a computational complexity in addition to said coding delay and said designated bit rate.

4. The speech coder as claimed in claim 3, wherein said control parameters include frame length and a subframe length.

5. A speech coding method for coding an input speech signal on the basis of control parameters, comprising:

receiving a coding delay and a designated bit rate as control data, and generating said control parameters on the basis of the coding delay and the designated bit rate; and determining, based on said control parameters, an input excitation signal, the determining performed so as to minimize distortion of a reproduced speech signal with respect to the input speech signal, the reproduced speech signal obtained by exciting a linear prediction synthesis filter prescribed by linear prediction coefficients of the input speech signal, wherein the coding delay is a time from when the input speech signal is received until a start of coding.

6. The speech coding method as claimed in claim 5, wherein said control parameters include a frame length and a subframe length.

7. The speech coding method as claimed in claim 5, wherein said receiving step further receives computational complexity as said control data.

8. The speech coding method as claimed in claim 7, wherein said control parameters include a frame length and a subframe length.

9. A speech decoder for restoring a reproduced speech signal from received coded speech data, the received coded speech data including an excitation signal, linear prediction synthesis filter coefficients, a designated bit rate and a coding delay, the decoder comprising:

a control circuit for receiving said designated bit rate and said coding delay as control data and generating control parameters on the basis of said designated bit rate and said coding delay; and a speech decoding means for first restoring the reproduced speech signal by second restoring the excitation signal and the linear prediction synthesis filter coefficients, the second restoring performed by decoding the received coded speech data based on the control parameters, the first restoring further including exciting a linear prediction synthesis filter prescribed by the linear prediction synthesis filter coefficients, on the basis of the excitation signal, wherein the coding delay is a time from when the input speech signal is received until a start of coding.

10. The speech decoder as claimed in claim 9, wherein said control parameters include a frame length and a subframe length.

11. A speech decoding method of restoring a reproduced speech signal from received coded speech data, the received coded speech data including an excitation signal, linear prediction synthesis filter coefficients, a designated bit rate and a coding delay, the method comprising:

generating control parameters on the basis of the designated bit rate and the coding delay; and first restoring a reproduced speech signal by second restoring the excitation signal and the linear prediction synthesis filter coefficients, the second restoring performed by decoding the received coded speech data based on the control parameters, the first restoring further including exciting a linear prediction synthesis filter prescribed by the linear prediction synthesis filter coefficients, on the basis of the excitation signal, wherein the coding delay is a time from when the input speech signal is received until a start of coding.

12. The speech decoding method as claimed in claim 11, wherein said control parameters include a frame length and a subframe length.

13. A bitstream generated by coding an input speech signal, said bitstream comprising:

a first bitstream indicative of an input excitation signal designed so as to minimize the distortion of a reproduced speech signal with respect to the input speech signal, the reproduced speech signal obtained by exciting a linear prediction synthesis filter prescribed by linear prediction coefficients of the input excitation signal, on the basis of the input excitation signal;

a second bitstream indicative of a coding delay; and a third bitstream indicative of a designated bit rate, wherein the coding delay is a time from when the input speech signal is received until a start of coding.

* * * * *